US010017990B2

(12) United States Patent
Charlton

(10) Patent No.: US 10,017,990 B2
(45) **Date of Patent: *Jul. 10, 2018**

(54) LADDER SAFETY DEVICE

(71) Applicant: Craig R. Charlton, Brisbane (AU)

(72) Inventor: Robert F. Charlton

( * ) Notice: Subject to any disclaimer, the term of this patent is extended or adjusted under 35 U.S.C. 154(b) by 0 days.

This patent is subject to a terminal disclaimer.

(21) Appl. No.: 14/732,330

(22) Filed: Jun. 5, 2015

(65) Prior Publication Data

US 2015/0267471 A1 Sep. 24, 2015

Related U.S. Application Data

(63) Continuation of application No. 14/047,951, filed on Oct. 7, 2013, now Pat. No. 9,085,937, which is a continuation-in-part of application No. 12/277,260, filed on Nov. 24, 2008, which is a continuation-in-part of application No. 11/628,641, filed as application No. PCT/AU2005/000861 on Jun. 17, 2005.

(51) Int. Cl.

| | |
|---|---|
| ***E06C 7/48*** | (2006.01) |
| ***E06C 7/18*** | (2006.01) |
| *B25B 5/06* | (2006.01) |

(52) U.S. Cl.

CPC ..... *E06C 7/486* (2013.01); *E06C 7/188* (2013.01); *B25B 5/06* (2013.01)

(58) Field of Classification Search

CPC . E06C 7/18; E06C 7/188; E06C 7/486; E06C 7/484; E06C 7/488; E06C 7/48; E06C 7/50; E06C 1/34; B25B 5/06; B25B 5/125

USPC ..... 248/231.41, 231.51; 182/206, 214, 93, 182/107, 111; 269/259–264, 266, 234, 269/215, 151, 163, 194

See application file for complete search history.

(56) References Cited

U.S. PATENT DOCUMENTS

| | | | | |
|---|---|---|---|---|
| 2,088,895 A * | 8/1937 | Connell | E06C 1/12 | 182/206 |
| 2,256,452 A * | 9/1941 | Marshall | E06C 7/48 | 182/214 |
| 2,595,699 A * | 5/1952 | Petersen | B25B 1/22 | 269/163 |
| 3,028,929 A * | 4/1962 | Chubbs | E06C 1/34 | 182/187 |

(Continued)

FOREIGN PATENT DOCUMENTS

| | | | |
|---|---|---|---|
| AU | 2005/000861 A1 | 12/2005 | |
| DE | 3504777 C1 * | 11/1986 | E06C 1/34 |

(Continued)

*Primary Examiner* — Daniel P Cahn

(74) *Attorney, Agent, or Firm* — Geoffrey E. Dobbin; Dobbin IP Law

(57) ABSTRACT

A ladder safety device is usable for holding and stabilizing a ladder in a safe and stable manner while being used, by way of securing a ladder relative to continuous horizontal guttering at the edge of a building. The device locks to the gutter by way of locking jaws and is secured to the side rail of a ladder by way of an adjustable locking bar—said locking bar being adjustable in lateral and normal directions. The jaws interact by an over-center relationship with each other. In an alternate embodiment, a trigger and locking mechanism secures the jaws in a closed position while in use.

20 Claims, 14 Drawing Sheets

(56) References Cited

U.S. PATENT DOCUMENTS 3,061,041 A * 10/1962 Taylor ..... E04D 13/064 182/129
3,486,580 A * 12/1969 Norton ..... E06C 7/48 182/111
3,603,431 A * 9/1971 Nameche ..... E06C 7/486 182/206
3,853,202 A * 12/1974 Jarboe ..... E06C 7/486 182/108
3,910,380 A * 10/1975 Nameche ..... E06C 7/48 182/206
4,018,301 A * 4/1977 Nameche ..... E06C 7/48 182/206
4,090,587 A * 5/1978 Pyle ..... E06C 7/48 182/206
4,143,743 A * 3/1979 Larson ..... E06C 7/48 182/107
4,541,155 A * 9/1985 Gagnon ..... B66C 1/64 24/486
4,545,460 A 10/1985 Byrd
4,834,352 A * 5/1989 Thornton ..... B25B 5/06 269/203
4,924,971 A 5/1990 Rice
5,265,854 A * 11/1993 Whiteford ..... B25B 5/06 269/166
5,383,533 A * 1/1995 Nikula ..... E04D 15/00 182/107
6,926,241 B2 * 8/2005 Garrett ..... B23D 45/003 182/107
7,134,525 B1 * 11/2006 Ferris ..... E06C 7/486 182/107
7,219,766 B2 5/2007 Deuer
8,316,993 B1 * 11/2012 Rudd ..... E06C 7/48 182/107
2004/0055820 A1 * 3/2004 Charlton ..... E06C 1/34 182/107
2007/0251762 A1 11/2007 Charlton
2009/0145693 A1 * 6/2009 Arseneault ..... E06C 7/486 182/206
2011/0253479 A1 * 10/2011 Gandy ..... E06C 7/486 182/107
2014/0262616 A1 * 9/2014 Cullum ..... E06C 7/188 182/107

FOREIGN PATENT DOCUMENTS

EP 1498571 A1 1/2005
GB 610261 4/1946
WO WO 02/059444 A1 8/2002
WO WO 2005/124089 A1 12/2005

* cited by examiner

LADDER SAFETY DEVICE

CROSS-REFERENCES TO RELATED APPLICATIONS

This application a continuing application of prior filed U.S. non-provisional application Ser. No. 14/047,951, filed Oct. 7, 2014 which is in turn a continuation-in-part of prior filed U.S. non-provisional application Ser. No. 12/277,260, filed Nov. 24, 2008, which is, in turn, a continuation-in-part of prior filed U.S. application Ser. No. 11/628,641, filed Dec. 6, 2006, which is in turn a national entry of prior filed PCT Application PCT/AU2005/000861, filed Jun. 17, 2005 and published Dec. 29, 2005 as WO 2005/124089. The prior domestic applications are incorporated by reference herein in their entirety.

FIELD OF THE INVENTION

This invention relates to an improved ladder safety device usable for holding a ladder in a safe and stable disposition while being used.

BACKGROUND OF THE INVENTION

Many forms of apparatus and devices have been proposed in the past, all with a goal of reducing accidents occasioned by lateral slippage of ladders placed so as to lean against buildings or other structures, especially against lengths of horizontal drainage guttering. A lengthy discussion on the danger factors is to be found in the specification of my International Patent Application No. PCT/AU02/00071 which is directly tied to the use of flexible connecting straps encircling ladder rungs and/or rails and having releasable engagement means securable where desired. Somewhat similar principles are illustrated in other patent specifications such as U.S. Pat. No. 4,924,971 to Rice and U.S. Pat. No. 4,545,460 to Byrd.

The present invention has been devised to provide a different approach to the problem of obtaining ladder stability, preferably without using flexible straps. Accordingly, its principal object is to provide a novel form of safety device which can be used more easily and positively than prior proposals, with low cost and simplicity, yet proving highly efficient in operation. Other objects and advantages of the invention will hereinafter be apparent.

SUMMARY OF THE INVENTION

Throughout the specification, the ladder safety devices are described by way of example in the principal application in securing a ladder relative to continuous horizontal guttering at the edge of a building. Such guttering typically has an inner web, a floor, and an outer web, the latter terminating in a roll-formed bead which may be of desired form such as circular, triangular or square in cross-section or simply flanged. The words "bead of the type described" are used herein to embrace any such structure against which the ladder may be placed regardless of design. If desired, it could be any rail type member, with or without conventional types of guttering. According to one aspect of the invention, there is provided a ladder safety device for stabilizing a ladder leaning against a horizontal bead of the type described, secured adjacent the edge of a building, said safety device including a portable, hand-held, jaw mounting body having first and second jaw members adapted, when the device is inoperative, to be spaced from one another whereby the device may be brought to a usage position and the body fitted over the bead so that the bead is accommodated between the two jaw members; actuating means associated with said body and adapted to be manually actuated to cause closing together of the jaw members and effect clamping of the bead relative thereto, and ladder securing means on the jaw mounting body and adapted to be secured to the ladder to restrain relative motion between the ladder and the body when the device has been brought to the usage position and said actuating means has been rendered operative.

In a preferred embodiment, the jaw mounting body includes a lower body portion on which said first jaw member is mounted substantially fixedly but adapted to be adjustably set in selected position beneath and outwardly of said bead. Preferably also, the jaw mounting body includes an upper body portion on which said second jaw member is mounted for pivotal movement about a horizontal axis between said raised inoperative positions spaced from the first jaw member and a lower clamping position in which it co-acts with the first jaw member and is disposed inwardly of said bead. Suitably, pivotal movement of the second jaw member is effected by a handle member pivotally connected thereto about a horizontal axis, the parts being so made and arranged that the handle is pivotally raised when the jaw members are spaced and inoperative but is swung down to a lower operative position adjacent the first jaw member when clamping is effected.

According to another preferred feature, locking means are provided to secure the second jaw member in its clamping position when the actuating means have been operated. Suitably, the locking means includes an over-center locking arrangement of the toggle locking type adapted to hold the jaw members effectively until the actuating means are released. In most instances, the jaw members are designed to effect clamping on opposite sides of an outer upwardly extending gutter web having its top edge formed into said bead so that the web will be gripped closely below said bead.

According to another preferred feature, the jaw mounting body is constituted by two side-by-side portions joined about a vertical joint, the upper ends having pivot mountings defining an axis for the pivoted second jaw member. Suitably, said vertical joint of the side-by-side body portions acts as a guide for a vertically adjustable mounting for the first jaw member. Suitably also, the first jaw member has a guide bolt passing through said vertical joint that is spring-loaded so that it is digitally slidable to a selected vertical position. It is preferred that the co-acting faces of the two jaw members are each fitted with a hard rubber or other similar elastomeric facing strip.

In a preferred embodiment, a quickly releasing trigger mechanism is provided for release of the actuating means when the latter is locked in a clamping position. Suitably, the trigger mechanism has at its lower end a locking lug engagable in said vertical joint in an aperture between said side-by-side portions.

In a similarly preferred embodiment, the ladder securing means includes a locking bar hinged to the jaw mounting body and adapted to fit snugly there-against when not in use, but able to swivel and to be movable releasably to and around a side rail of a ladder located beside the device when the device is in use. Preferably, the locking bar is mounted for connection to a ladder at either side of the device when in use.

In an alternative preferred embodiment, the ladder securing means includes a locking bar which passes through holes on the top of the jaw mounting body, being able to extend out via a controlled extension mechanism e.g. a spring activated locking device or a ratchet mechanism, able to swivel around a side rail of a ladder located beside the device when the device is in use.

A further alternative improvement and preferred embodiment for securing the side rail of the ladder to the safety device is an extension of the ladder locking bar so that the ladder locking device may be used to secure ladders on either side of the ladder in the one design by simply sliding such locking bar from side to side. This alternative improved design is purely an extension of the locking bar which passes through holes on the top jaw mounting body and being able to extend out either side via a controlled extension and locking mechanism, e.g. a spring activated or ratchet mechanism, to prevent slippage of the locking bar and also to release the bar when required. This sliding bar mechanism allows for the side rail of the ladder to be fully stabilized against the side body of the ladder safety device.

Another major securing feature of the ladder safety device is that the ladder locking bar can be raised or lowered to accommodate ladders of varying widths and at the same time securing such rails preventing any backward movement whilst in use by adjusting the locking bar down against the top side of the ladder rail. This height adjustment mechanism is spring loaded and is simply activated by a threaded micro-adjusting wheel nut which is easily accessed at the mid-top front of the ladder safety device.

As a further feature, the handle member for actuating the clamping jaw member is also designed for use in carrying the device between usage locations. Other features of the invention are hereinafter described.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

In order that the invention may be more readily understood and put into practical effect, reference will now be made to the accompanying drawings wherein.

DETAILED DESCRIPTION OF THE PREFERRED EMBODIMENTS OF THE INVENTION

With reference now to the drawings, the preferred embodiment of the ladder safety device is herein described. It should be noted that the articles "a", "an", and "the", as used in this specification, include plural referents unless the content clearly dictates otherwise.

Figure 1:
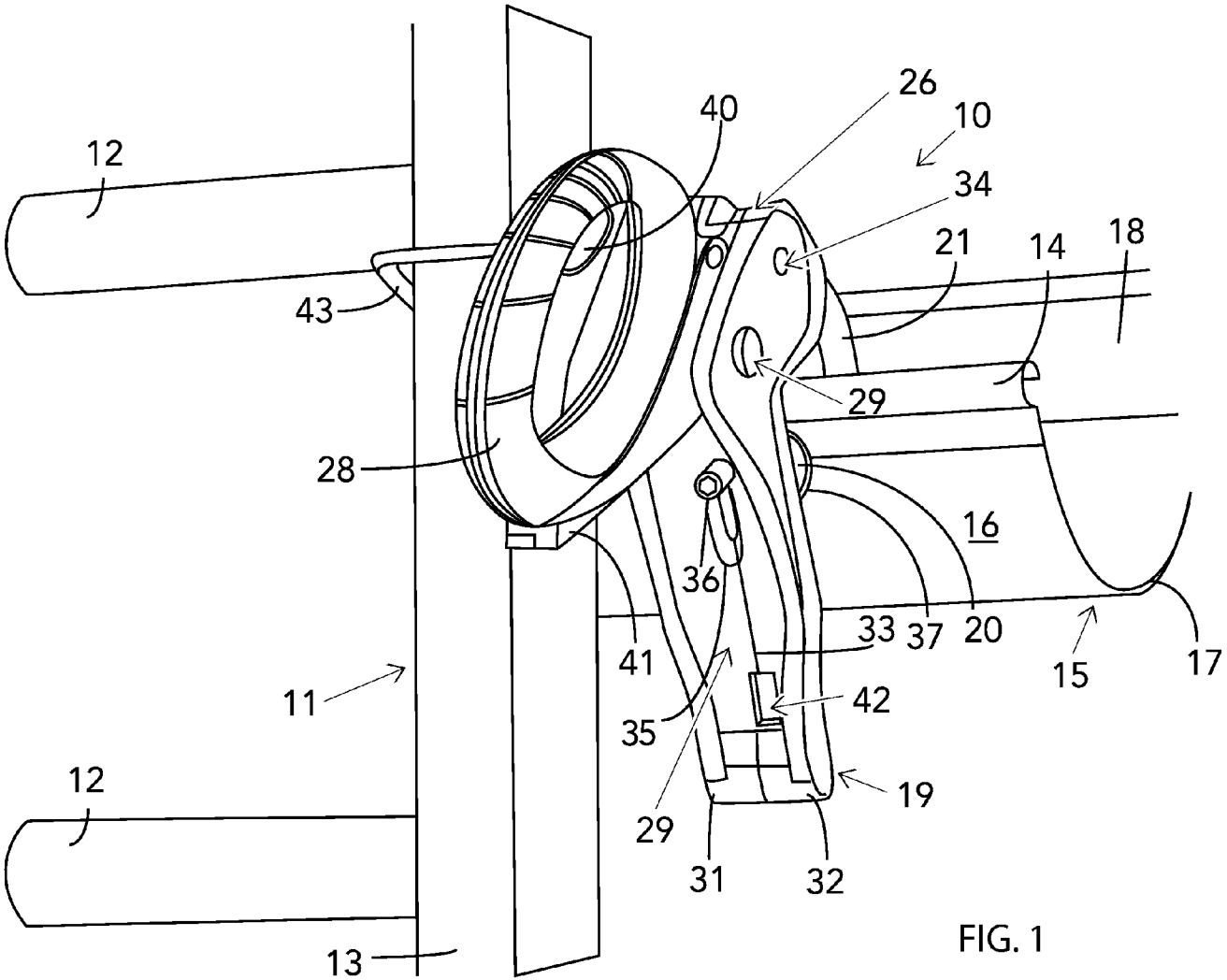
FIG. 1 is a perspective view of a preferred embodiment of a ladder safety device according to the present invention, shown attached to a ladder, and shown in a preliminary, inoperative attitude prior to use.
Figure 2:
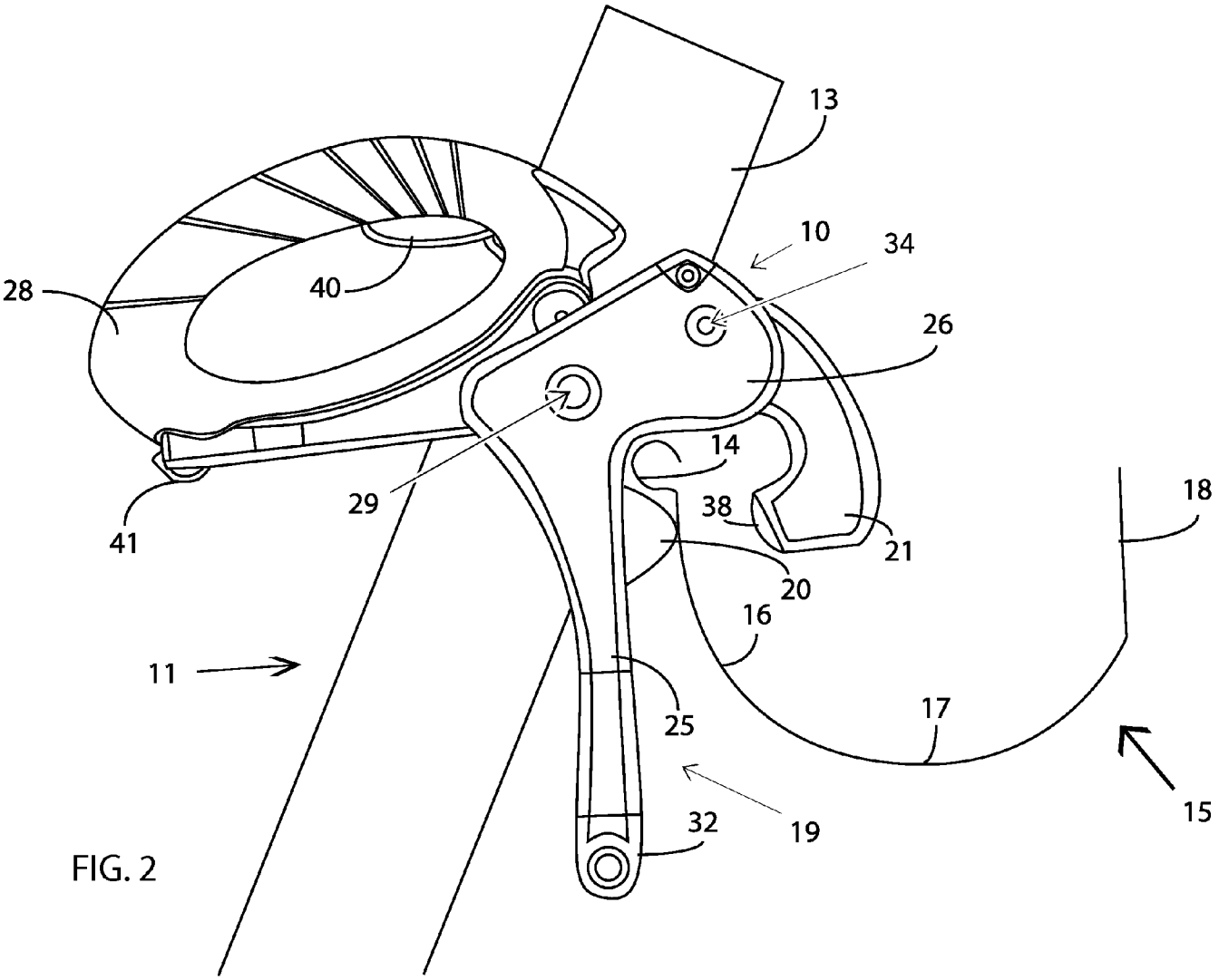
FIG. 2 shows in side elevation the device illustrated in FIG. 1, again in the attitude prior to use.
Figure 3:
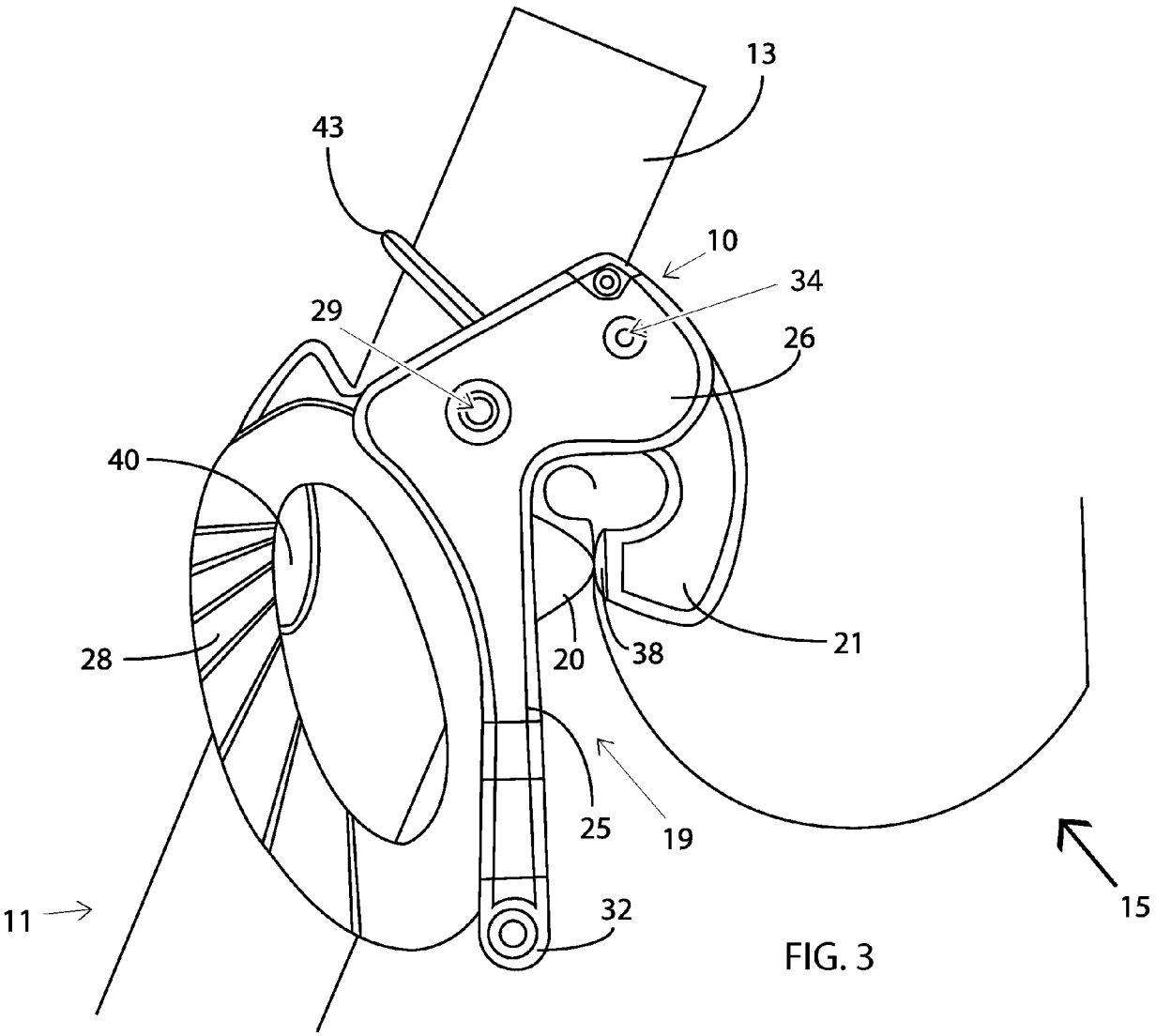
FIG. 3 is a side elevation corresponding to FIG. 2 but with the actuating means operated so that the jaws are in clamping positions as in use.

As shown in the FIGS. 1-3, the device indicated generally at 10 is for use in stabilizing a ladder 11 having horizontal rungs 12 and vertical rails 13. In this instance, the ladder 11 is leaning against a horizontal bead 14 of a gutter 15 at the edge of an outer upwardly extending gutter web 16 integral with a gutter floor 17 and inner web 18 by which the gutter 15 is secured to a building (not shown).

Figure 4:
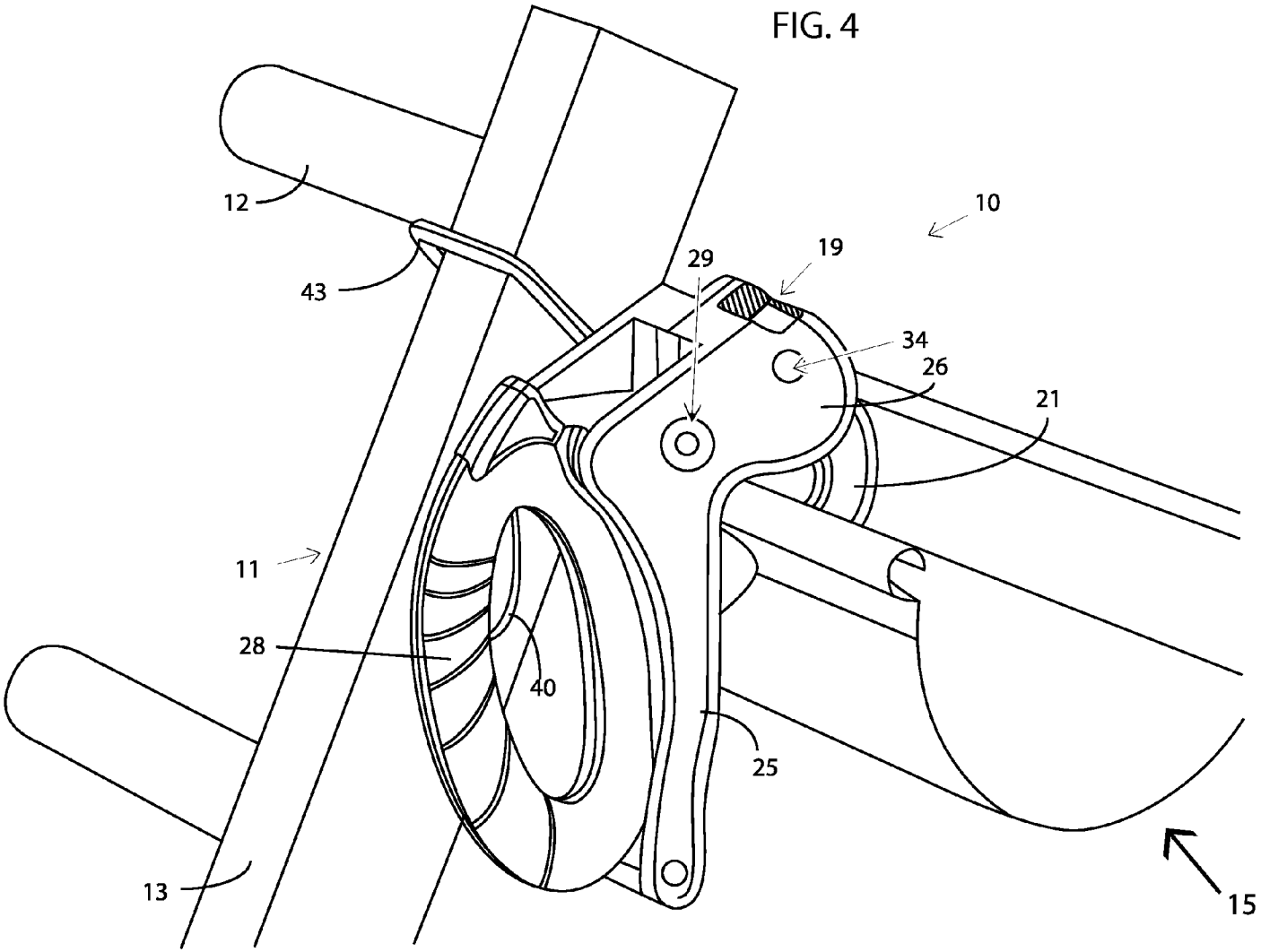
FIG. 4 shows the components in the same attitudes as in FIG. 3, but as a perspective view similar to FIG. 1.
Figure 5:
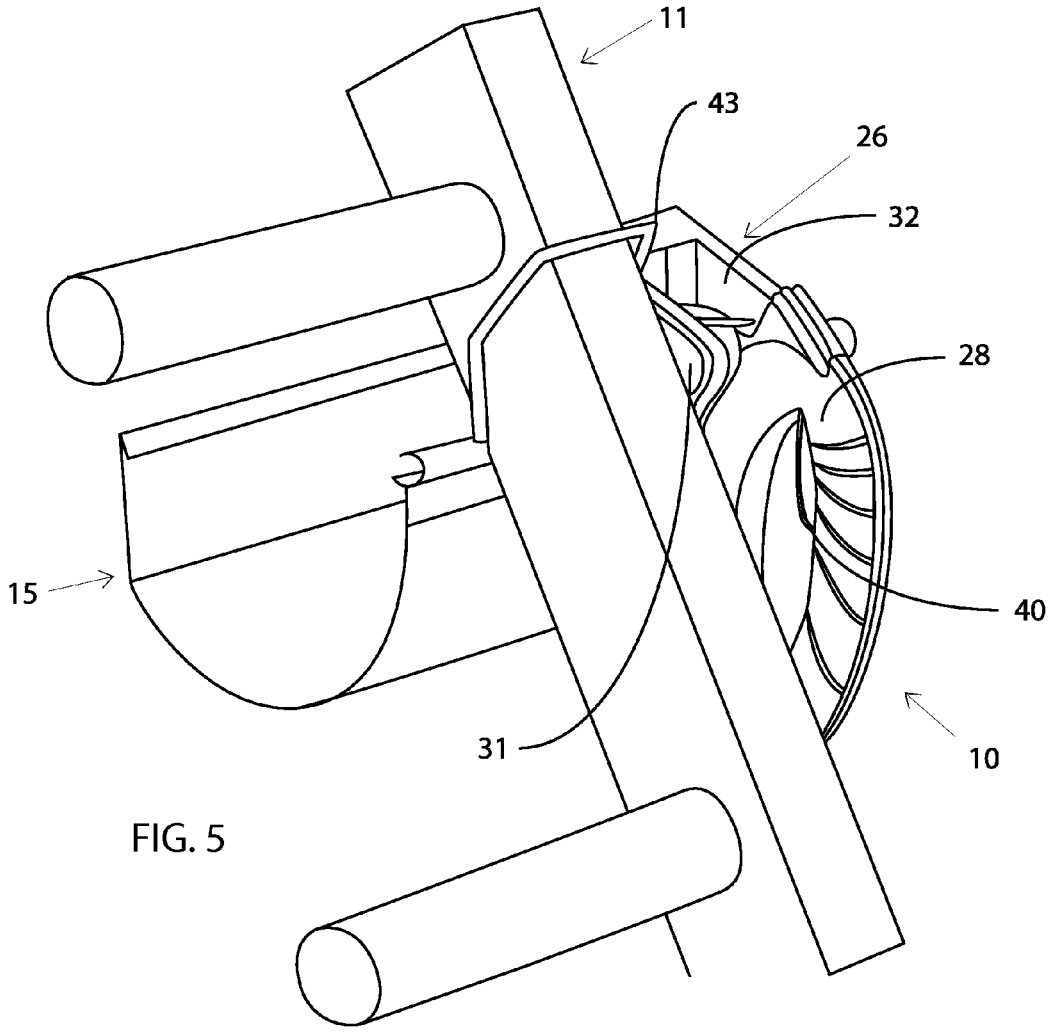
FIG. 5 is another perspective view similar to FIG. 4 but taken from the opposite side of the ladder and device.

It will be seen that the device 10 includes a portable, hand-held, jaw mounting body 19 having first jaw member 20 and second jaw members 21 adapted, when the device is inoperative, to be spaced from one another as shown in FIGS. 1 and 2, whereby the device may be brought to usage position and the body 19 fitted over the bead 14 so that the bead is accommodated between the two jaw members 20 and 21, as shown in FIG. 3. Actuating means, outwardly shown by handle 28, are associated with said body 19 and are adapted to be manually actuated to cause closing together of the two jaw members 20 and 21 and effect clamping of the bead 14 relative thereto. Ladder securing means, depicted in the figures by a securement bar 43, are provided on the jaw mounting body 19 and adapted to be secured to the ladder rail 13 to restrain relative motion between the ladder and the jaw mounting body 19 when the device 10 has been brought to usage position and said actuating means has been rendered operative, as apparent from FIGS. 3 to 5.

It will be seen that the jaw mounting body 19 includes a lower body portion 25 on which said first jaw member 20 is mounted substantially fixedly but adapted to be adjustably set in selected position beneath and outwardly of the bead 14 as best shown in FIGS. 1 and 12-15. The jaw mounting body 19 includes also an upper body portion 26 on which the second jaw member 21 is mounted for pivotal movement about a horizontal axis 34 between the raised, inoperative positions spaced from the first jaw member 20 and a lower clamping position as shown in FIG. 3 in which it co-acts with the first jaw member 20 and is disposed inwardly of the bead 14.

It will be seen that pivotal movement of the second jaw member 21 is effected by a handle member 28 pivotally connected thereto about a horizontal axis 29. By comparing FIGS. 2 and 3, it will be noted that the handle 28 is pivotally raised when the jaw members are spaced apart and inoperative but is swung down to a lower operative position adjacent to the first jaw member 20 when clamping is effected.

Locking means are provided to secure the second jaw member 21 in its clamping position when the actuating means have been operated. The locking means includes linkages, pivots and levers between the handle 28 and second jaw 21 to achieve an over-center arrangement of the toggle-locking arrangement of the jaw members 20, 21 and is adapted to hold the jaw members effective until the actuating means are released. By this, it is meant that the second jaw member 21 extends over the gutter web and contacts the inside of the gutter while the first jaw member is positioned on the outside of the gutter. The second jaw 21 effects clamping by then moving over a center axis defined by the two jaws, where the gutter is located, and locks inside the gutter across from the first jaw. As shown in FIGS. 2 and 3, the jaw members 20 and 21 are designed to effect clamping on opposite sides of the outer, upwardly extending gutter web 16 which has the said bead 14 at its top. Most desirably, the web 16 will be gripped closely below said bead 14 as shown in FIG. 3.

The locking means includes a further pivot (FIGS. 12-15) between the upper components so that a "past dead center" toggle action (FIG. 13) can be obtained.

The jaw mounting body 19 will be seen to be constituted by two side by-side portions 31 and 32 which mirror each other and are joined about a vertical joint 33, the upper ends providing a mounting axis 34 for the pivoted second jaw member 21. It will be seen from FIG. 1 that the vertical joint 33 of the side by-side body portions 31 and 32 acts as a guide for a vertically adjustable mounting for the first jaw member 20. In this regard, the first jaw member 20 has a spring-loaded guide bolt 36 passing through said vertical joint 33 so that it is digitally slidable along a trough 35 in the vertical joint to a selected vertical position. It will also be noted that the co-acting faces of the two jaw members are fitted with facing strips 37,38 suitably of hard rubber or similar elastomeric material.

A feature of the invention is the provision of a quickly releasable trigger mechanism 40 for release of the actuating means 22 when the actuating means 22 is locked in a clamping position. The trigger mechanism 40 is connected by linkage in the handle 28 to a lower locking lug 41 of hooked form engagable in the vertical joint 33 in a shouldered aperture 42 defined between the side-by-side portions 31 and 32 (FIGS. 1, 12-15).

Figure 7:
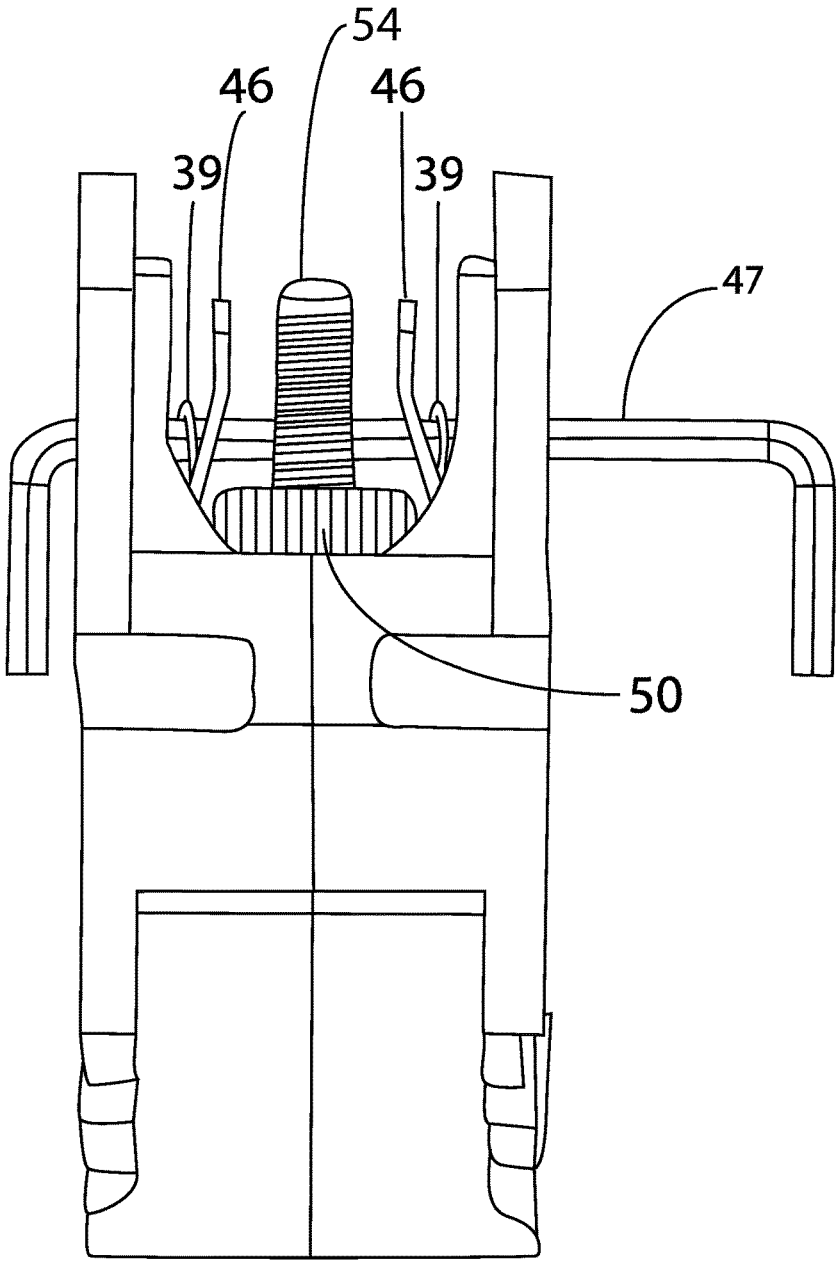
FIG. 7 shows the adjustable mechanism for sliding bar and the micro-adjustment wheel nut.

Also, the ladder-securing means includes a locking bar 43 hinged to the jaw mounting body 19 and fitting snugly against it when not in use, but able to swivel and to be movable releasably to and around the side rail 13 of the ladder 11 located beside the device when the device is in use (FIGS. 1-5). This prevents the ladder side rail from moving backwards whilst in use (FIG. 7). As a simple design feature, the locking bar 43 is mounted for connection to the ladder 11 when the device 10 is at either side thereof. As will be apparent, the handle member 28 for actuating the clamping jaw member 21 is also designed for use in carrying the device between usage locations.

Figure 6:
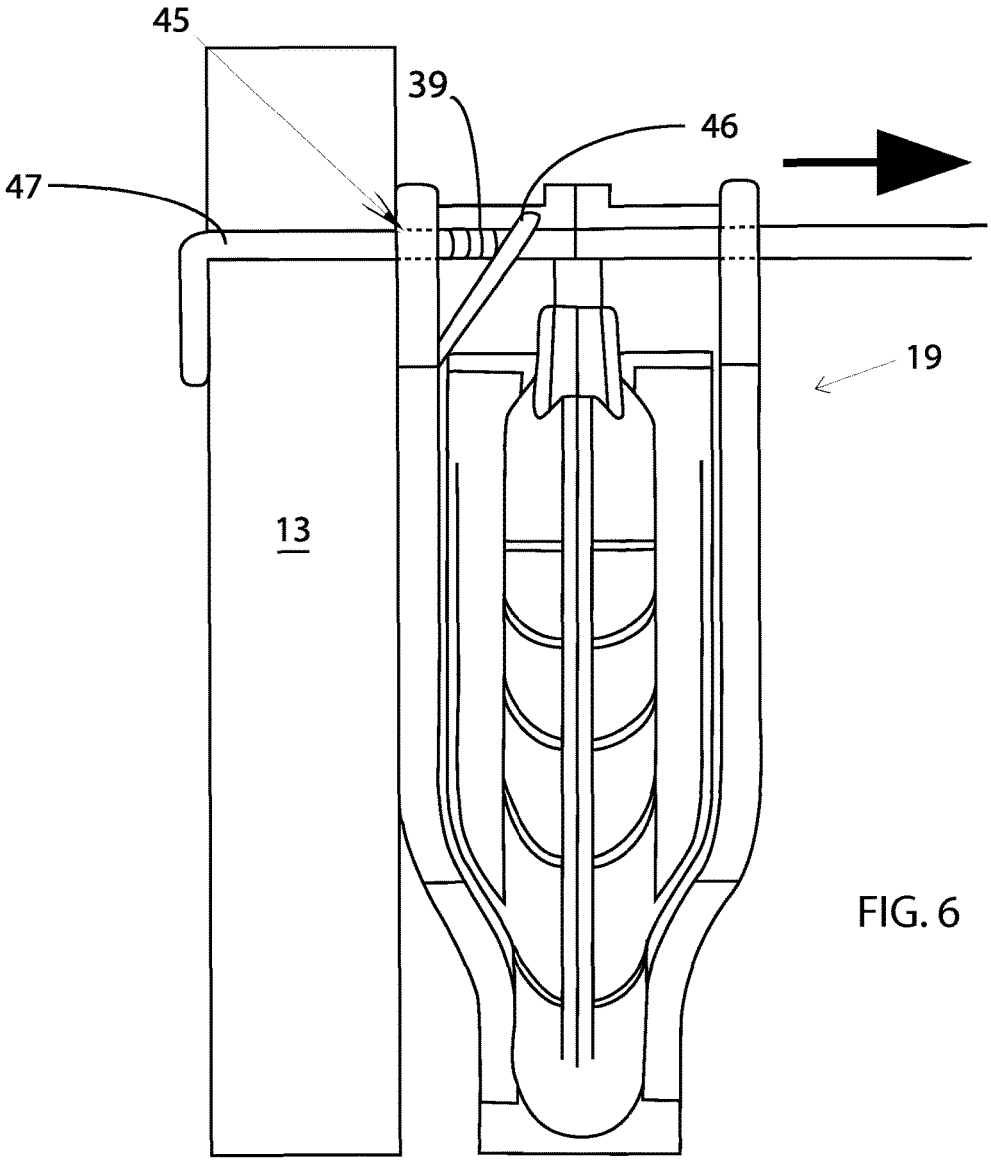
FIG. 6 shows a front elevation of the alternative locking bar passing through holes on top of the jaw mounting body.
Figure 8:
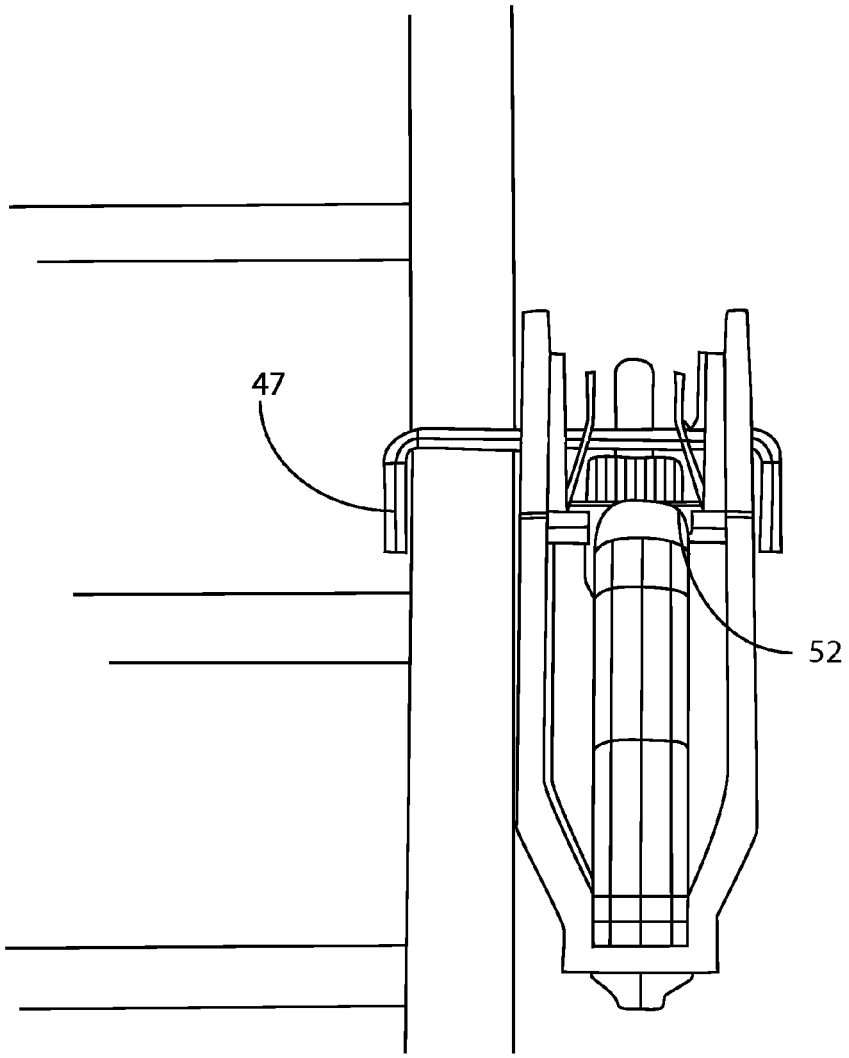
FIG. 8 shows the ladder being secured by sliding bar against the safety device.

The ladder-securing means may also include an alternative locking bar 47 which passes through securing holes 45 on the top of the jaw mounting body 19 (FIG. 6). There is a spring activated locking device through which the locking bar 47 passes. This locking device is essentially a hinged, rigid leaf 46 through which the locking bar passes. The leaf 46 is angled obtusely in relation to the locking bar 47 and is spring-biased 39 in that position. As a result, the locking bar 47 is in contact with the leaf 46 and, if the locking bar 47 is pushed in the direction of bias on the leaf 46 (shown as the arrow in FIG. 6), the leaf 46 and locking bar 47 will interact to arrest the movement of the locking bar 47. However, if the bias on the leaf 46 is countered, the leaf 46 loses contact with the locking bar 47 and gains a neutral position, which allows free movement of the locking bar 47 therethrough. If the locking bar 47 is pushed against the direction of the bias on the leaf 46, the locking bar 47 will push the leaf 46 into the neutral position. The use of a second, opposite, locking mechanism, as shown in FIGS. 7-8, is preferred. When the locking bar 47 is positioned to fit snugly around the side rail of the ladder, the spring activated locking device is released to lock the locking bar 47 in that position, thus locking the ladder against the device. The spring activated locking device could also be replaced by a ratcheting mechanism, which would utilize teeth in the locking bar, allowing the mechanism to lock the locking bar in position at the required position. The dual sided locking bar 47 allows the ladder safety device to be used on either side of the ladder.

Figure 9:
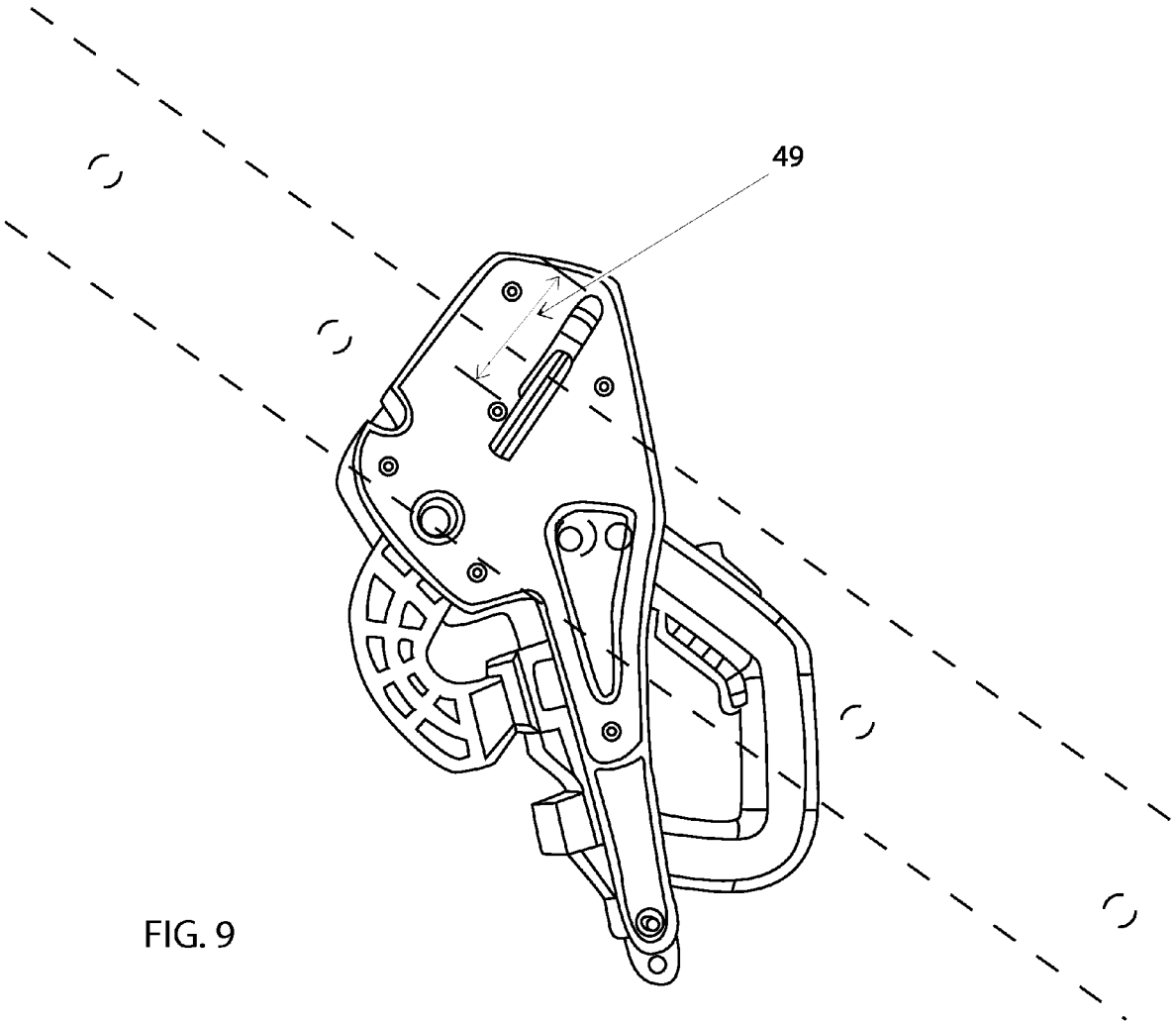
FIG. 9 shows the up and down adjustable bar securing the side rail of the ladder.
Figure 10:
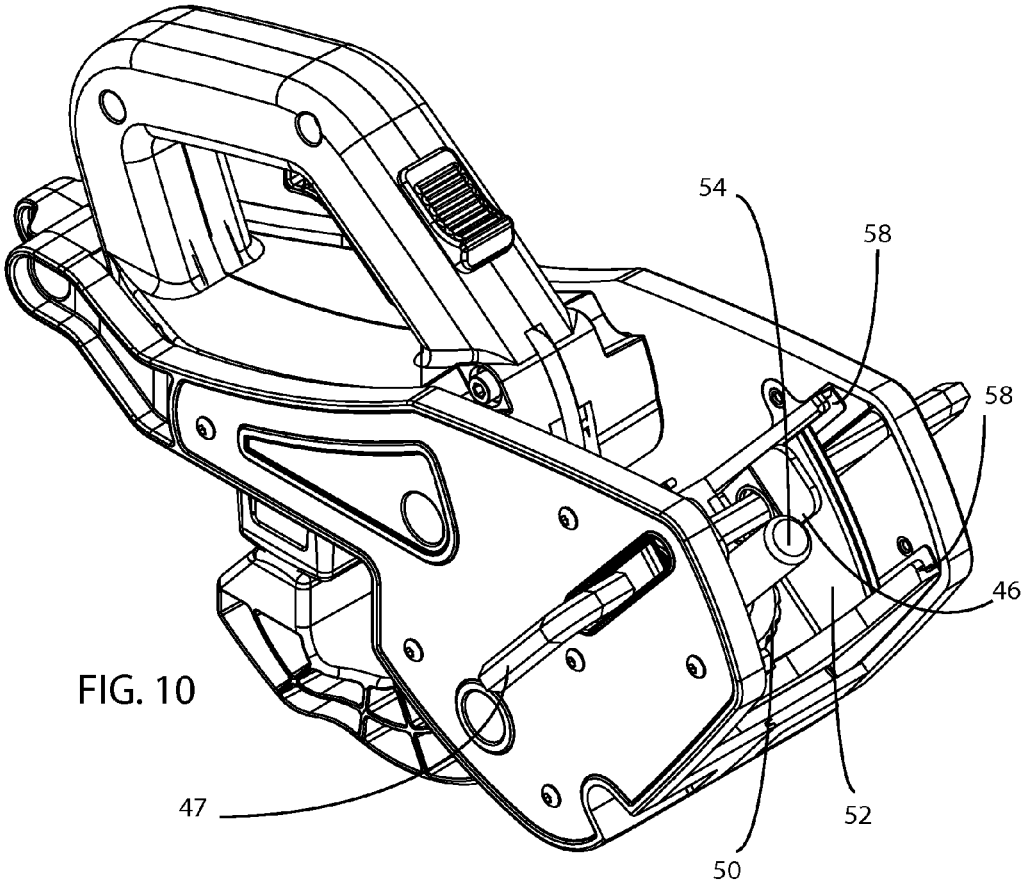
FIG. 10 is a top perspective view of the preferred embodiment of the ladder safety device.

The locking bar 47 may also be raised and lowered relative to the safety device (FIG. 9) and secured in position, thereby being able to be adjusted up or down to secure ladders of varying rail widths 49. The locking bar raise and lower mechanism is spring loaded 46 and is simply activated by a threaded wheel nut 50 which is easily accessed at the mid-top front of the ladder safety device.

Figure 11:
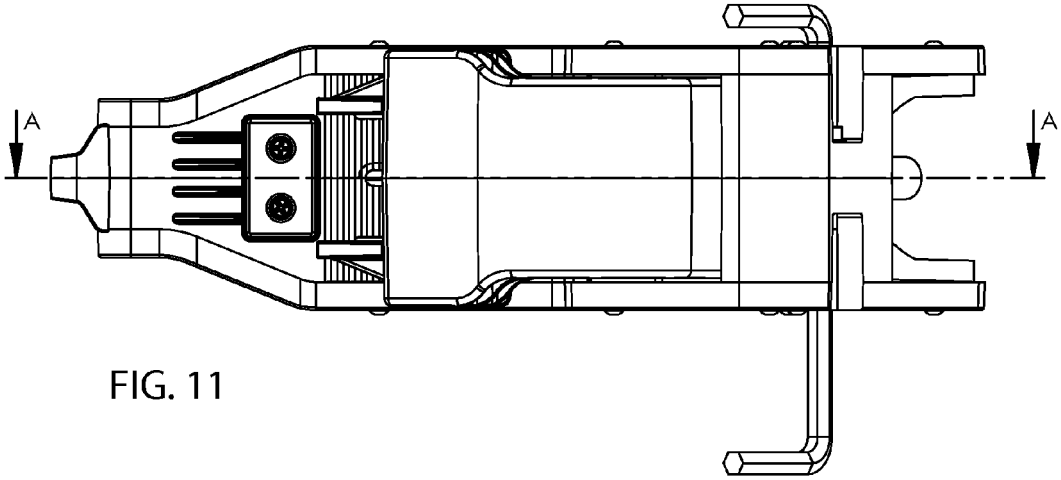
FIG. 11 is a bottom plan view of the ladder safety device of FIG. 10.
Figure 12:
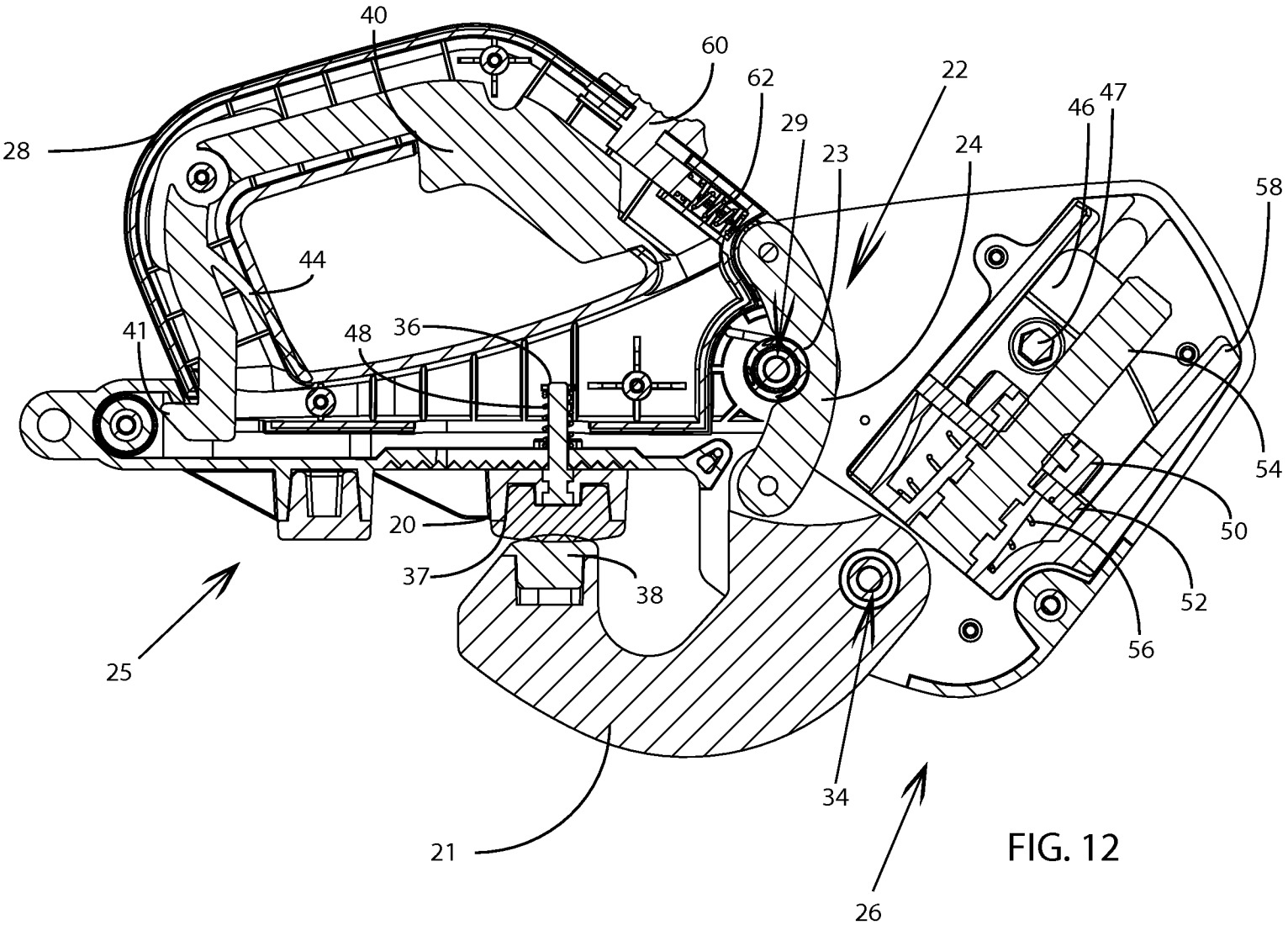
FIG. 12 is a sectional view of the ladder safety device of FIG. 11, taken along line A-A, in a closed configuration.

More detailed operation of the preferred embodiment of the ladder safety device is depicted in FIGS. 9-15, as well as the preferred actuation means 22. As can be seen in FIG. 11, the ladder safety device, in its closed position, has the two jaw bodies juxtaposed and contacting each other at their friction strips 37, 38. Second jaw member 21 is mounted to the upper jaw body 26 about an axis 34 and connected to an arcuate linkage 24. The arcuate linkage 24 is also connected to the handle 28, which is in turn also mounted to the upper jaw body 26 about an axis 29. Both the second jaw member 21 and the handle 28 will pivot about their connections to the arcuate linkage 24, thus forming two pivotable mounting points for both the handle and second jaw member 21. The jaw second jaw member 21 and handle 28 are spring biased 23 so that releasing the handle 28 will cause the jaw members to open.

The handle 28 is secured in the closed position by a trigger 40 and locking mechanism residing inside the handle. A safety latch 60 is biased into the main body of the trigger in order to prevent accidental actuation. The safety latch 60 prevents movement by the trigger body unless it is first moved against a spring bias 62 which normally keeps in a secured position. The trigger body, when compressed, pivots slightly, compressing a leaf spring 44, and moves a locking lug 41 located at its distal end. The locking lug 41 disengages from an aperture 42 in the lower jaw body 25 and, in turn, the handle 28 and second jaw member 21 are released. Once the locking lug 41 is outside the aperture 42, the trigger 40 may be released and the leaf spring 44 will then restore the trigger 40 to its default position.

Figure 13:
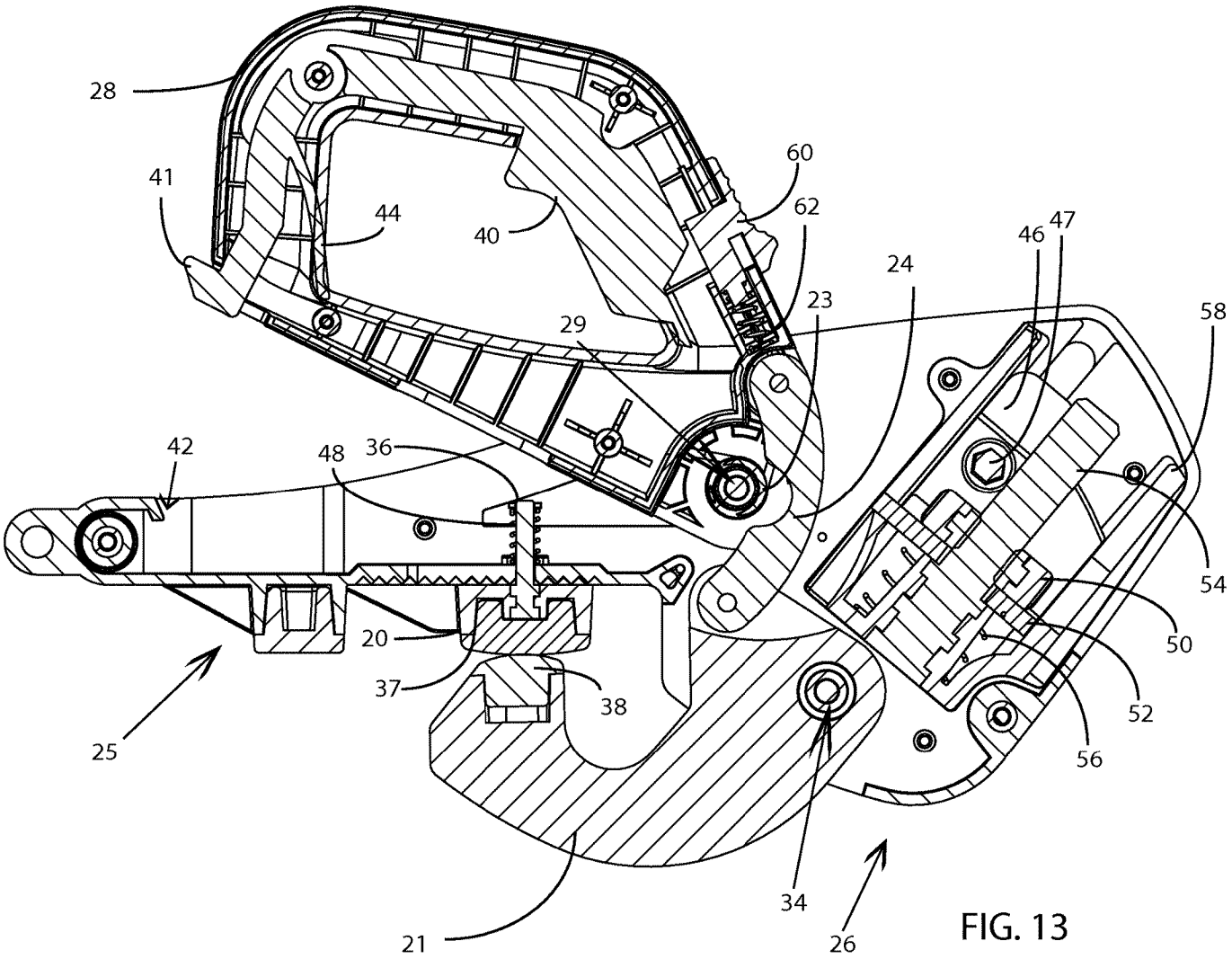
FIG. 13 is a sectional view of the ladder safety device of FIG. 12, in a mostly closed (dead past center) position.
Figure 14:
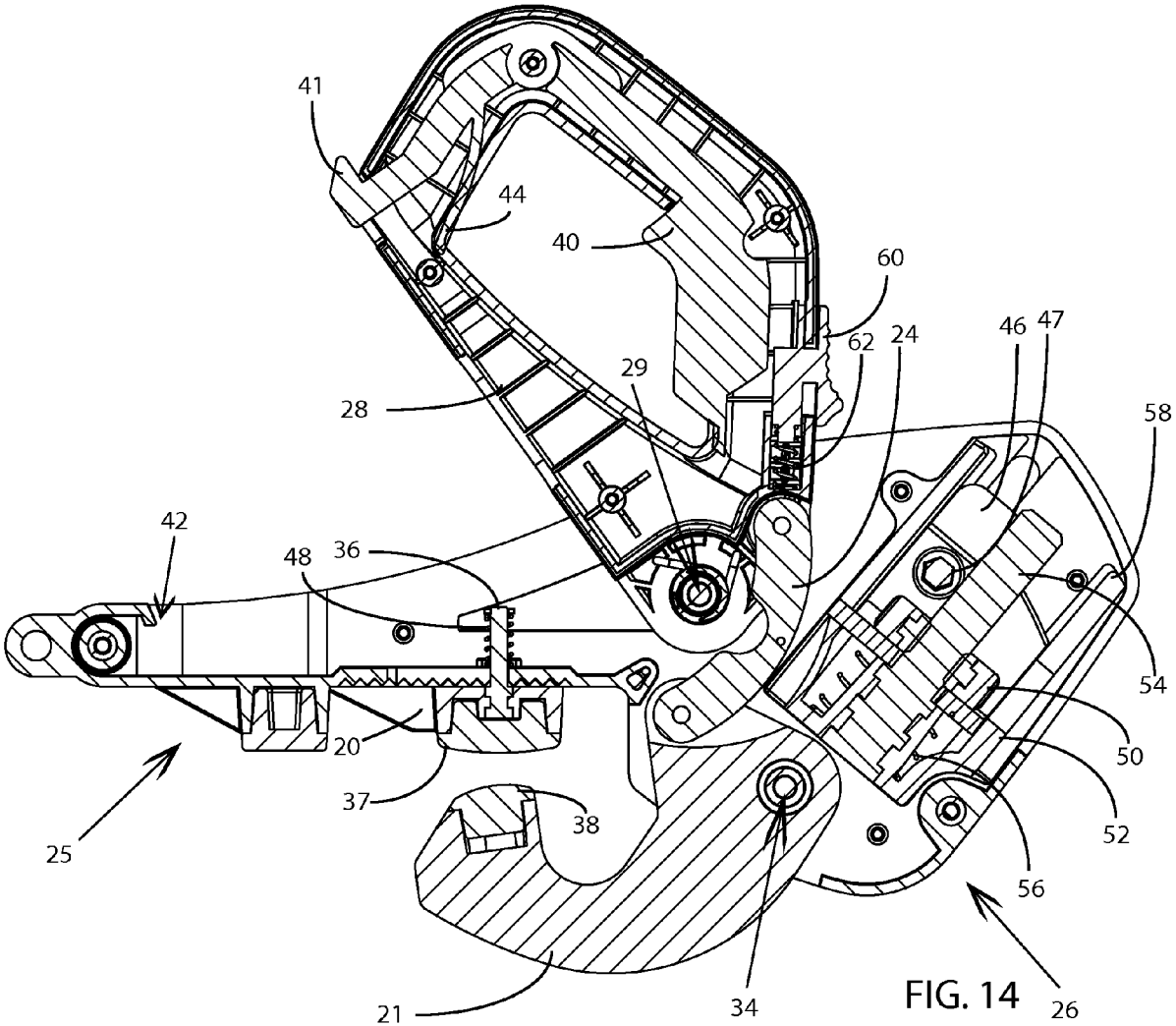
FIG. 14 is a sectional view of the ladder safety device of FIG. 12 in a half closed configuration.
Figure 15:
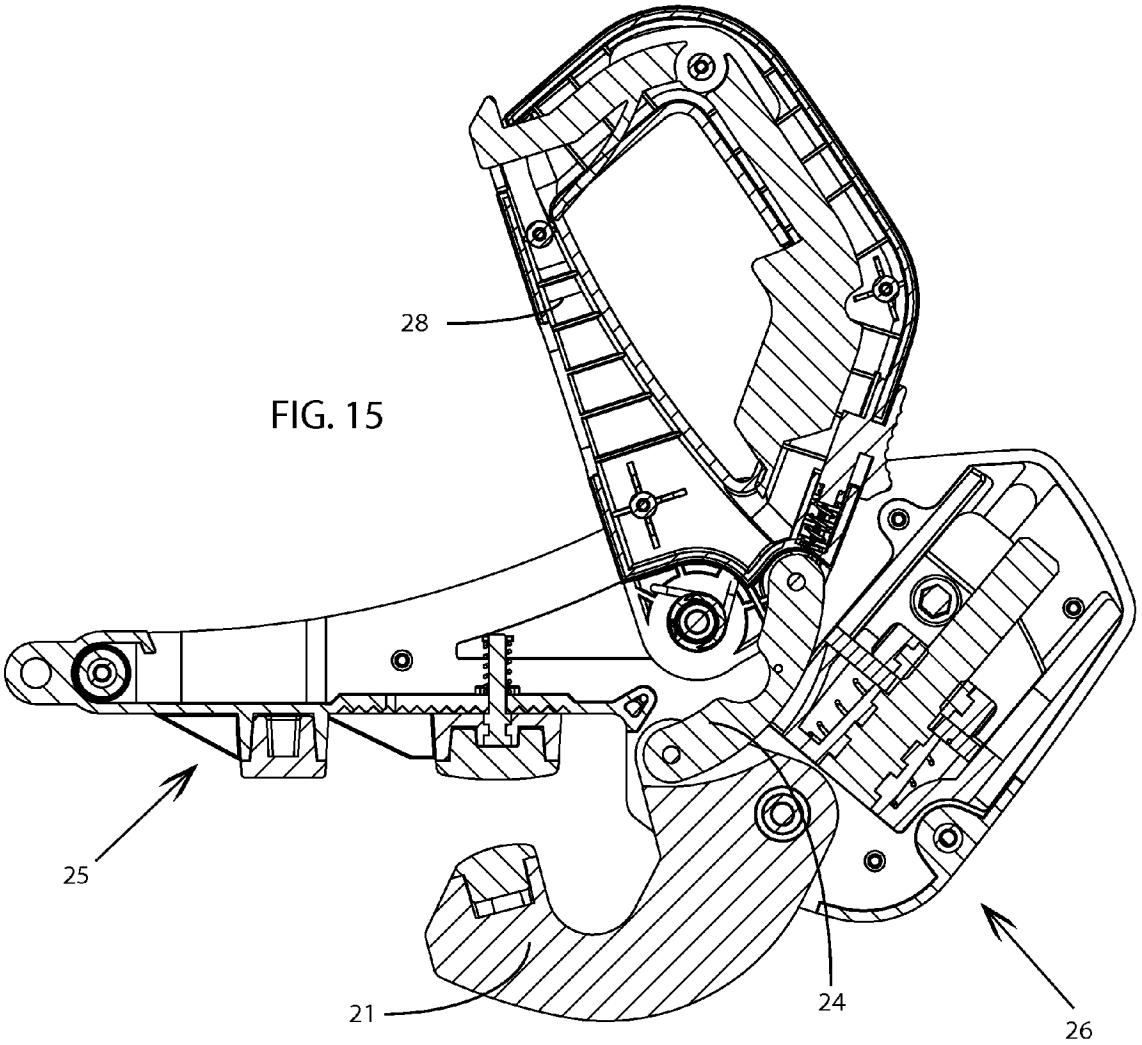
FIG. 15 is a sectional view of the ladder safety device of FIG. 12 in an open position.

While opening, the jaws will achieve a "dead past center" arrangement (mostly closed), as shown in FIG. 13. In this position, or in any of the more open positions, the first jaw adjustment may be accessed. As can be seen in the FIGS. 11-15, the first jaw member is mounted upon an end of the guide bolt 36 which is biased by a spring 48 to hold the first jaw member 20 against the lower jaw body 25. Pulling the jaw member 20 away from the jaw body 25 or pressing on the guide bolt 36 compresses the spring 48 and releases the first jaw member 20 for movement along the guide in the vertical joint 33 (FIG. 1).

Complete opening of the jaw members is accomplished by further rotating the handle 28 about its axis 29, which forces arcuate link 24 downward, against the second jaw member 21. This force, in turn, pivots the second jaw member 21 about its axis 34 until the jaws a fully opened in an over-center arrangement. In closing the jaws, the handle 28 is swung downwards, pulling on the arcuate linkage 24 and therefore the second jaw member 21 until the jaws close and the handle 28 is anchored in the lower jaw body 25 by locking lug 41 interfacing the shouldered aperture 42.

The locking bar may be raised and lowered relative to the device by means of an adjustable platform assembly. The locking bar 47 is mounted upon a platform 52 which is, in turn, mounted about a threaded post 54 over a spring 56. A wheel nut 50 secures the platform 52 about the threaded post 54 and, when tightened, forces the platform 52 down the threaded post 54, against spring pressure. When loosened, the spring pressure forces the platform 52 up the threaded post 54, against the wheel nut 50. The platform is held in place by a set of troughs 58, with which it interfaces, in the upper jaw body 26.

The manner of using the device 10 will be clear from the drawings and preceding descriptions but in any event is self-evident. The device is light in weight and readily portable in a hand-held manner, and its compactness affords simple and safe movements at all times. The single handle is used initially for carrying the device, and then for putting it in the appropriate usage location over the bead, and then for effecting clamping and automatic locking in a past-dead-center toggle action, similar to a louver window handle action. The locking bar is simple but effective, and the locking components have rigidity over an adequate length along the bead and guttering so that stability and safety are achieved.

While devices as described and illustrated will be found very effective in achieving the objects for which the invention has been devised, it will be understood that the embodiment described is illustrative only and may be subject to many modifications of constructional detail and design, as will be readily apparent to persons skilled in the art and without departing from the broad scope and ambit of the invention as defined by the appended claims.

I claim:

1. A ladder stabilizing device configured to stabilize a ladder relative to a gutter secured adjacent to an edge of a building, said gutter and said edge of the building being substantially parallel with the gutter having a gutter web which further has a top edge formed into a horizontal bead, the ladder having two parallel side rails connected by a plurality of ladder rungs, each ladder rung having a major axis where the major axes of each of the ladder rungs are parallel to each other and are perpendicular to the side rails, said ladder stabilizing device comprising:

a. a portable jaw mounting body having two lateral sides joined about a vertical joint;

b. first and second jaw members extending towards a front of the jaw mounting body, said second jaw member being movable relative to the first jaw member between an open configuration and a closed configuration, such that the first and second jaw members are configured to be spaced farther apart from one another while in the open configuration than while in the closed configuration, the jaw mounting body of the ladder stabilizing device being configured to be positioned over the bead of the gutter so that the web of the gutter is accommodated between the first and second jaw members as the first and second jaw members are moved from the open configuration to the closed configuration resulting in clamping the ladder stabilizing device onto the web of the gutter;

c. a handle operatively connected to the second jaw member and configured to pivot the second jaw member between the open and closed configurations, the handle being pivotally connected to the jaw mounting body at a first axis, the second jaw member being pivotally connected to the jaw mounting body at a second axis spaced from the first axis; and d. a fixed length locking bar extending through upper ends of the lateral sides of the jaw mounting body, the locking bar movable in a lateral direction, parallel to the major axes of the ladder rungs during engagement to the ladder for use the locking bar moves through the jaw mounting body to enable the locking bar to be extended on each side of the jaw mounting body to engage one of the side rails of the ladder and secure the ladder stabilizing device to the ladder, the locking bar comprising an adjustment mechanism configured to adjustably secure the locking bar at a selected locking bar position along the lateral direction, and the locking bar having a spring loaded mounting assembly configured to adjustably raise and lower a section of the locking bar inside of the jaw mounting body such that a direction of said raising and lowering is orthogonal to the lateral direction during said engagement to the ladder for use.

2. The ladder stabilizing device according to claim 1, wherein said second jaw member is configured to be disposed inwardly of said bead during use.

3. The ladder stabilizing device according to claim 2, the handle operably engaging the second jaw member such that when the handle is pivotally raised the first and second jaw members are in the open configuration and when the handle is swung down to a lower position, adjacent the first jaw member, the first and second jaw members are in the closed configuration.

4. The ladder stabilizing device of claim 1, the handle having a trigger release mechanism comprising a locking lug releasably engaged with a shouldered aperture in the jaw mounting body to releasably lock the handle to the jaw mounting body and the jaws in the closed configuration.

5. The ladder stabilizing device according to claim 4, wherein the locking lug and the shouldered aperture are positioned to interface with each other when the handle is in a lower position.

6. The ladder stabilizing device according to claim 4, wherein the locking lug is positioned at a lower end of the handle.

7. The ladder stabilizing device according to claim 1, further comprising elastomeric strips fitted upon at least one of the two jaw members.

8. The ladder stabilizing device according to claim 1, wherein said spring loaded mounting assembly comprises a platform, a spring, a wheel nut located above said platform and a threaded post passing through said spring, said platform, and said wheel nut such that rotating the wheel nut raises and lowers the platform and controls positioning of the locking bar along said direction orthogonal to the lateral direction.

9. The ladder stabilizing device according to claim 1, wherein said adjustment mechanism is configured to provide a secure connection of the locking bar to the ladder and to provide a disconnection of the locking bar from the ladder, the adjustment mechanism comprising at least one locking bar spring surrounding a portion of the locking bar and at least one hinged leaf angularly biased against the locking bar by the at least one locking bar spring.

10. The ladder stabilizing device according to claim 1, wherein the handle is also designed for use in carrying the device between usage locations.

11. The ladder stabilizing device of claim 9, wherein said at least one locking bar spring is a first locking bar spring surrounding a first portion of the locking bar and a second locking bar spring surrounding a second portion of the locking bar, and said at least one hinged leaf is a first hinged leaf and a second hinged leaf respectively biased against the first and second locking bar springs, wherein said locking bar springs are biasing in opposite directions relative to one another.

12. A ladder stabilizing device configured to stabilize a ladder relative to a gutter secured adjacent to an edge of a building, the gutter having a gutter web which further has a top edge formed into a horizontal bead, the ladder having two parallel side rails connected by rungs, said ladder stabilizing device comprising:

a. a portable jaw mounting body having two lateral sides joined about a vertical joint;

b. first and second jaw members extending towards a front of the jaw mounting body, said second jaw member being movable relative to the first jaw member between an open configuration and a closed configuration, such that the first and second jaw members are configured to be spaced farther apart from one another while in the open configuration than while in the closed configuration, the jaw mounting body of the ladder stabilizing device being configured to be positioned over the bead of the gutter so that the web of the gutter is accommodated between the first and second jaw members as the first and second jaw members are moved from the open configuration to the closed configuration resulting in clamping the ladder stabilizing device onto the web of the gutter;

c. a handle operatively connected to the second jaw member and configured to pivot the second jaw member between the open and closed configurations, the handle being pivotally connected to the jaw mounting body at a first axis, the second jaw member being pivotally connected to the jaw mounting body at a second axis spaced from the first axis; and d. a fixed length locking bar extending through upper ends of the lateral sides of the jaw mounting body, the locking bar movable in a lateral direction with respect to the jaw mounting body such that the locking bar moves through the jaw mounting body to enable the locking bar to be extended on each side of the jaw mounting body to engage one of the side rails of the ladder and secure the ladder stabilizing device to the ladder, the locking bar comprising an adjustment mechanism configured to adjustably secure the locking bar at a selected locking bar position along the lateral direction, and the locking bar having a spring loaded mounting assembly configured to adjustably raise and lower the locking bar with respect to a direction orthogonal to the lateral direction, the spring loaded mounting assembly further comprising:

i. a platform;

ii. a spring;

iii. a wheel nut located above said platform; and iv. a threaded post passing through said spring, said platform, and said wheel nut such that rotating the wheel nut raises and lowers the platform and controls positioning of the locking bar along said direction orthogonal to the lateral direction.

13. The ladder stabilizing device of claim 12, wherein said second jaw member is configured to be disposed inwardly of said bead during use.

14. The ladder stabilizing device of claim 13, the handle operably engaging the second jaw member such that when the handle is pivotally raised the first and second jaw members are in the open configuration and when the handle is swung down to a lower position, adjacent the first jaw member, the first and second jaw members are in the closed configuration.

15. The ladder stabilizing device of claim 12, the handle having a trigger release mechanism comprising a locking lug releasably engaged with a shouldered aperture in the jaw mounting body to releasably lock the handle to the jaw mounting body and the jaws in the closed configuration.

16. The ladder stabilizing device of claim 15, wherein the locking lug and the shouldered aperture are positioned to interface with each other when the handle is in a lower position.

17. The ladder stabilizing device of claim 15, wherein the locking lug is positioned at a lower end of the handle.

18. The ladder stabilizing device of claim 12, further comprising elastomeric strips fitted upon at least one of the two jaw members.

19. The ladder stabilizing device of claim 12, wherein said adjustment mechanism is configured to provide a secure connection of the locking bar to the ladder and to provide a disconnection of the locking bar from the ladder, the adjustment mechanism comprising at least one locking bar spring surrounding a portion of the locking bar and at least one hinged leaf angularly biased against the locking bar by the at least one locking bar spring.

20. The ladder stabilizing device of claim 19, wherein said at least one locking bar spring is a first locking bar spring surrounding a first portion of the locking bar and a second locking bar spring surrounding a second portion of the locking bar, and said at least one hinged leaf is a first hinged leaf and a second hinged leaf respectively biased against the first and second locking bar springs, wherein said locking bar springs are biasing in opposite directions relative to one another.

* * * * *